US005467064A

United States Patent [19]

Gu

[11] Patent Number: 5,467,064

[45] Date of Patent: Nov. 14, 1995

[54] EMBEDDED GROUND PLANE FOR PROVIDING SHIELDED LAYERS IN LOW VOLUME MULTILAYER TRANSMISSION LINE DEVICES

[75] Inventor: Wang-Chang A. Gu, Albuquerque, N.M.

[73] Assignee: Motorola, Inc., Schaumburg, Ill.

[21] Appl. No.: 187,967

[22] Filed: Jan. 28, 1994

[51] Int. Cl.[6] ..... H01P 5/12

[52] U.S. Cl. ..... 333/128; 333/120; 333/161; 333/238; 333/246

[58] Field of Search ..... 333/26, 116, 120, 333/128, 161, 162, 204, 238, 246

[56] References Cited

U.S. PATENT DOCUMENTS

| | | | |
|---|---|---|---|
| 4,494,083 | 1/1985 | Josefsson et al. | 333/246 X |
| 5,146,191 | 9/1992 | Mandai et al. | 333/161 |
| 5,369,379 | 11/1994 | Fujiki | 333/116 |

*Primary Examiner*—Paul Gensler
*Attorney, Agent, or Firm*—James A. Coffing

[57] ABSTRACT

An electrical circuit (400) includes a first input means (401) for providing an input signal, a first output means (406) for providing an output signal, and a transmission line device (405) electrically positioned between the first input means (401) and the first output means (406). The first transmission line device includes a first ground plane (409) disposed on a first dielectric substrate (402), a first conductive layer (405-1) enclosing a first area on a second dielectric substrate (403) that is positioned substantially adjacent to the first dielectric substrate (402). The transmission line device (405) further includes a second conductive layer (405-2) that encloses an area corresponding to the first area on a first major surface of a third dielectric substrate (404) that is positioned substantially adjacent to the second dielectric substrate. Lastly, an embedded ground plane (411) is disposed on a fourth dielectric substrate (412)that is positioned substantially between the second dielectric substrate (403) and the third dielectric substrate (404).

10 Claims, 6 Drawing Sheets

100

200

300

400

500

EMBEDDED GROUND PLANE FOR PROVIDING SHIELDED LAYERS IN LOW VOLUME MULTILAYER TRANSMISSION LINE DEVICES

FIELD OF THE INVENTION

The present invention relates generally to electrical circuits, and in particular to such circuits that require shielding between integrated low volume transmission line devices.

BACKGROUND OF THE INVENTION

Electrical transmission lines are used to transmit electric energy and signals from one point to another. The basic transmission line connects a source to a load—e.g. a transmitter to an antenna, an antenna to a receiver, or any other application that requires a signal to be passed from one point to another in a controlled manner. Electrical transmission lines, which can be described by their characteristic impedance and their electrical length, are an important electric component in radio frequency (RF) circuits. In particular, transmission lines can be used for impedance matching—i.e., matching the output impedance of one circuit to the input impedance of another circuit. Further, the electrical length of the transmission line, typically expressed as a function of signal wavelength, determines another important characteristic of the transmission line device.

Manipulation of the characteristic impedance and electrical length of the transmission line device is a well known technique to effect a particular electrical result. In particular, an output impedance, $Z_{out}$, can be matched to an input impedance, $Z_{in}$, according to a well known equation, as later described. Similarly, the attenuation and phase shift of the transmission line device can be altered by changing the physical length of the conductor between the input and output ports of the transmission line device. As an example, a resonant circuit results when the physical length of the conductor approximates an even one-quarter wavelength of the signal's nominal frequency.

Of course, at high frequencies the wavelength is small and transmission line devices can be built using relatively short conductors in small packages. By contrast, as the nominal frequency of the applied signal decreases, the physical length must necessarily increase to effect the desired transmission line characteristic. The physical length must correspondingly increase to accommodate such applications operating at lower frequencies.

Prior art techniques, including microstrip and stripline conductors, have been used successfully in the past to construct transmission line devices. Unfortunately, at lower frequencies— e.g., below 1 GHz—the substrates upon which these one-dimensional conductive strips are placed require a relatively large area, due to the excessive length requirements. As today's electronic devices shrink in size, the board space allotted for the necessary electrical components is correspondingly reduced. Thus, a substrate carrying a microstrip or a stripline conductor that serves as a transmission line device for low frequency signals simply cannot be accommodated by the available board space.

Another technique that is employed can be described as a helical structure disposed inside a grounding cylinder. Such helical coils are well known in the art, but these too are often inadequate for today's applications, where low volume and low cost are critical factors in the manufacture of portable electronic devices. Because of the tight length and impedance specifications, the helical structures become very costly to manufacture. That is, the manufacturing variance that is inherent in the construction of such devices—e.g. conductor diameter, symmetry of windings, and effective number of turns— tends to make the helical structure a less desirable solution for tight tolerance transmission line devices. Further, the cylindrical grounding portion, which feature is required when building a transmission line device, results in a circuit having a relatively large volume, or poor form-factor, that is untenable for many of today's applications.

Of course, as the number of transmission line devices required for a particular circuit increases, so too does the volume required for embodying those devices within the circuit. Aside from the increased volume, though, another undesired effect is promulgated when multiple transmission line devices or even single devices requiring many turns to effect the desired electrical length—are needed in the circuit. Of these problems, one of the most serious tends to be a so called ground-shielding effect. That is, when multiple turns are required for a particular application, the outermost coils-those coils closest to the external ground plane—tend to block, or shield, the innermost conductors from that ground plane. In particular, due to the symmetrical nature of the turns that make up the coil structure, the outermost conductors become an obstacle between the innermost conductors and the ground plane, thereby terminating the electric field lines propagated therebetween.

The obstruction in the electric field path results in a reduced capacitive effect, and therefore an undesirably high inductive reactance, for the structure. This becomes an even greater problem when many transmission line devices, or many turns for each of the devices required, become necessary to effect the desired characteristics for the circuit.

Accordingly, there exists a need for an electrical circuit arrangement that substantially eliminates the problems associated with inter-stage shielding in coil structures for transmission line devices. In particular, such a circuit that provided a less obstructed path between each of the coil sections to ground, for each of the transmission line devices, would be an improvement over the prior art.

DETAILED DESCRIPTION OF A PREFERRED EMBODIMENT

An electrical circuit that requires transmission line devices can advantageously employ multi-layer ceramic processing techniques to provide transmission line devices. The electrical circuit includes at least a first input terminal and a first output terminal for providing electrical access to at least a first transmission line device. The first transmission line device includes at least a first ground plane located on a first dielectric substrate, a first conductive layer disposed on a second dielectric substrate that is substantially adjacent to the first dielectric substrate and a second conductive layer disposed on a first major surface of a third dielectric substrate. The first and second conductive layers each at least partially enclose a corresponding area on their respective dielectric substrates, and are advantageously isolated from each other using an embedded ground plane. Arranging the conductive layers and an embedded ground plane in this manner facilitates a circuit design requiring a lower characteristic impedance by adding capacitive reactance among the inductive coil structures. Further, integration of multiple transmission line devices into the same package is made more practical by having ground planes embedded within the package.

Figure 1:
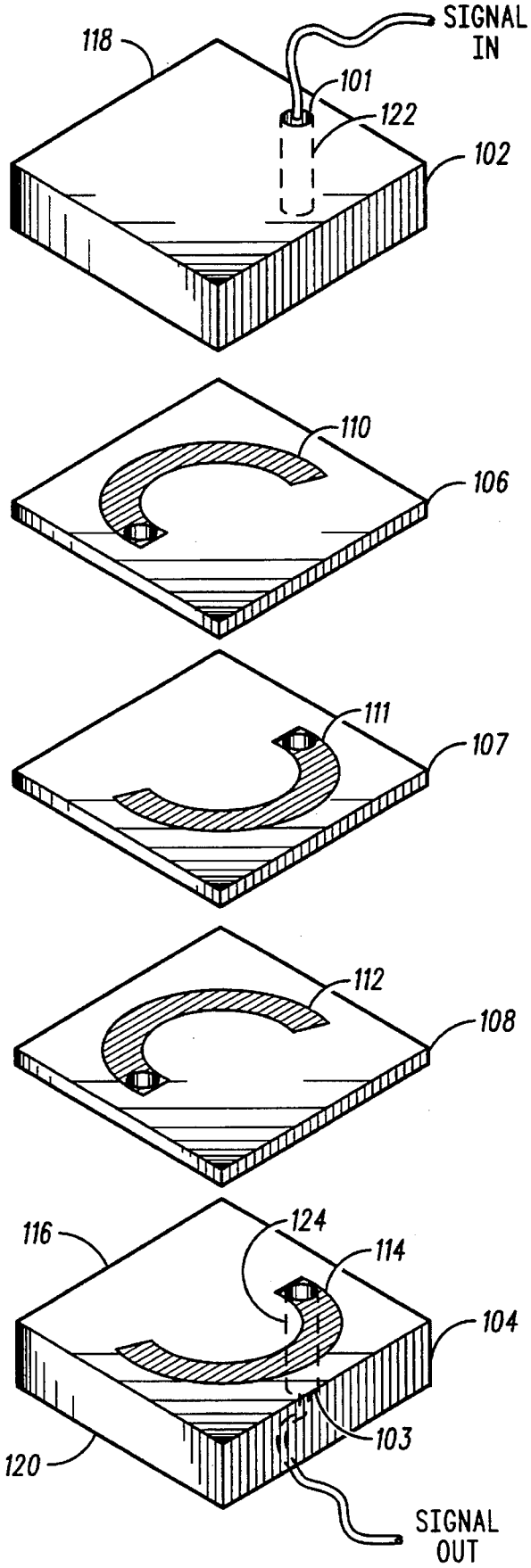
FIG. 1 shows a multilayer ceramic transmission line device using vertically stacked half-ring conductors, in accordance with the present invention.

The present invention can be more fully described with reference to FIGS. 1–6. FIG. 1 shows a multilayer substrate arrangement 100 that, when assembled, provides a device having transmission line characteristics. That is, a transmission line device is formed between a signal input port 101 disposed on a top substrate 102 and a signal output port 103 disposed on a bottom substrate 104. Further, intermediate substrates 106–108 (three shown, but could be more or less) provide support structure for conductive patterns, or layers 110–112, which layers at least partially enclose an area on their respective dielectric substrates 106–108. Another conductive layer 114 is disposed on a first major surface 116 of the bottom substrate 104. The top substrate 102 further includes a metallized area 118 that serves as a ground plane for the transmission line device. Similarly, the bottom substrate 104 preferably includes a second ground plane, disposed on a second major surface 120 thereof, which second ground plane generally insures a more stable circuit package due to the shielding, symmetry and boundary effects of the second ground plane. Finally, conductive vias 122, 124 are used to carry the input and output signals through the top substrate 102 and the bottom substrate 104, respectively. In this manner, a multiple-turn coil is provided that is substantially adjacent to one, or preferably two, ground plane(s) to effect a low-volume transmission line device.

In a preferred embodiment, the dielectric substrates 102, 104, 106–108 are formed using ceramic materials that can be co-fired with a co-fireable metal composition. Further, the conductive layers 110–112, 114 are preferably deposited on the dielectric substrates as provided by, for example, DuPont's Green Tape™, Systems, thereby producing conductive layers having relatively conductance values. Similarly, the conductive vias 122, 124—as well as the vias formed on the intermediate substrates 106–108, not shown-are made by at least partially filling the volume of spatially arranged, pre-punched holes in the ceramic using the co-fireable metal composition. Lastly, it should be noted that while conductive layers 110–112 are shown in FIG. 1 as being annulus structures in the form of a half-ring, other annulus structures can be readily employed depending on the application requirements, as next described. Further, while input/output terminals are shown here as being on opposite surfaces of the package, it is understood that they could easily be placed on the same surface. It is critical only that the transmission line device is electrically positioned between the input and output terminals.

Figure 2:
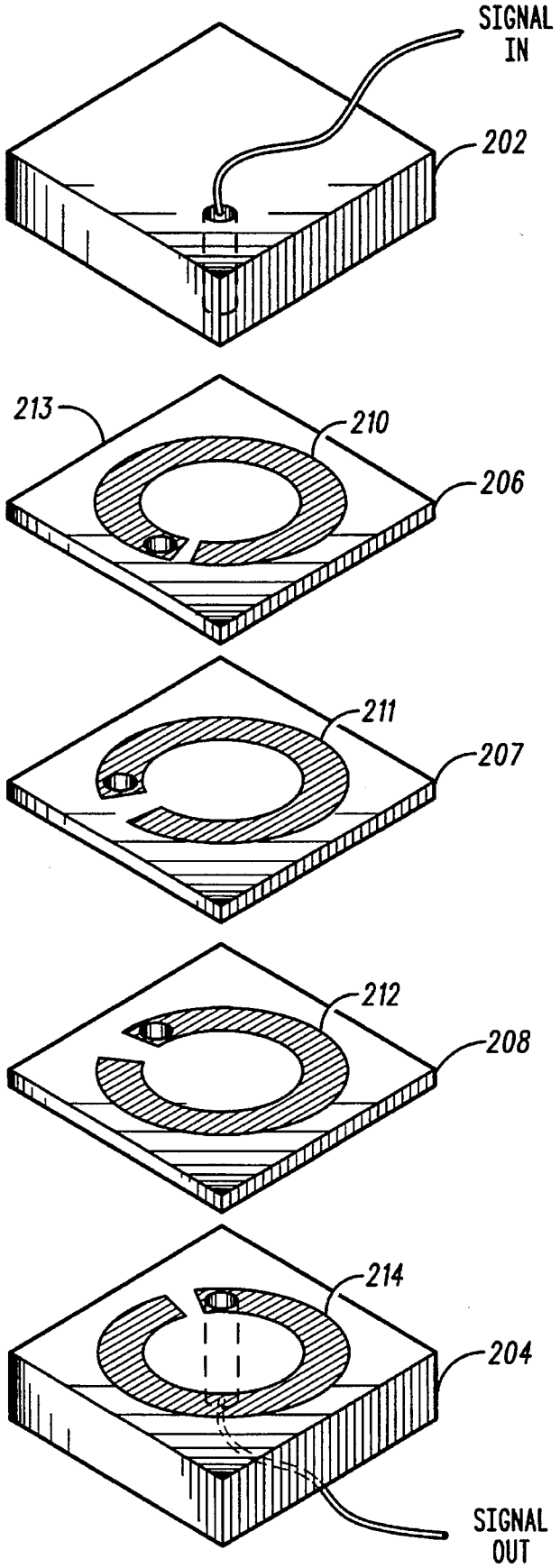
FIG. 2 shows a multilayer ceramic transmission line device using vertically stacked full-ring conductors, in accordance with the present invention.

FIG. 2 shows a multilayer substrate arrangement 200, including top substrate 202, that employs full-ring annulus structures as the conductive layers, in accordance with an alternate embodiment of the invention. That is, the annulus 210 comprises a nearly complete circular layer that substantially encloses an area 213 on the dielectric substrate 206. Similarly, the annuli 211, 212, 214 comprise near complete circular layers that substantially enclose areas on their dielectric substrates 207, 208, 204 respectively, which areas correspond to the substantially enclosed area 213. Employing annulus structures 210–212 in this manner provides for increasing the physical length of the conductive layers—and hence the electrical length of the transmission line—using the same number of ceramic layers. Of course, this allows for reduced volume of dielectric material required and significantly lower manufacturing costs, as compared to transmission line designs of the prior art.

Figure 3:
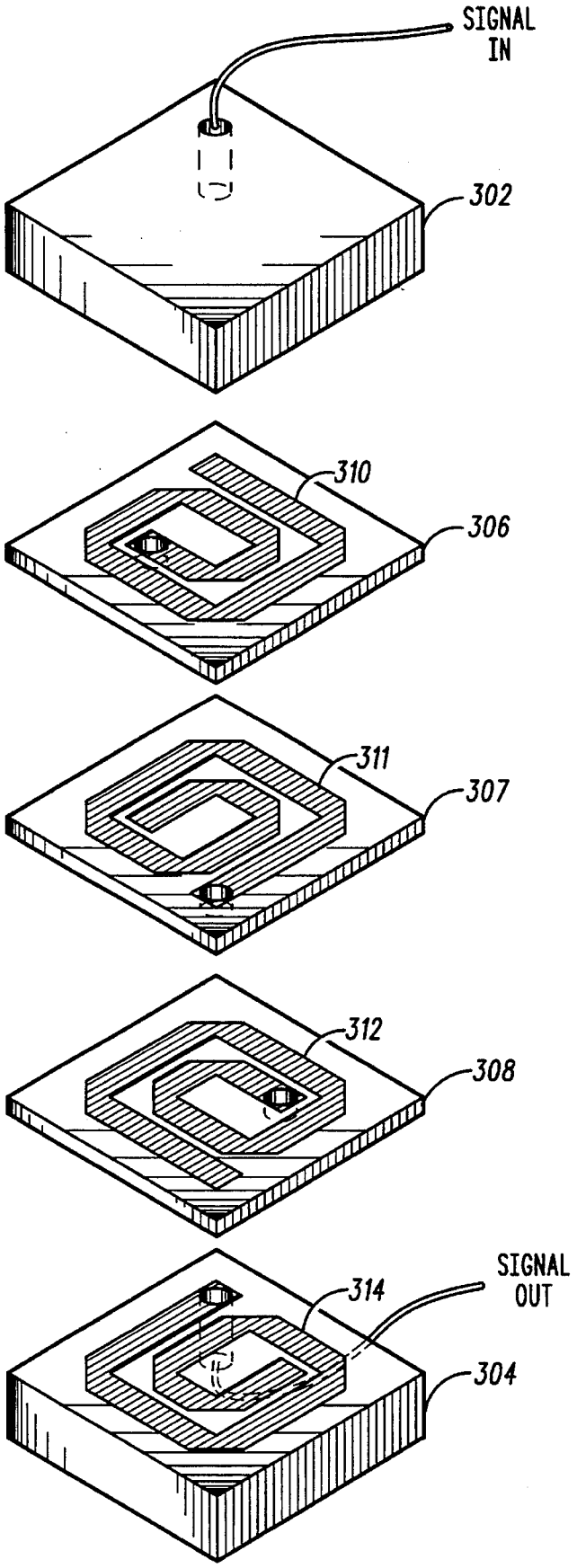
FIG. 3 shows a multilayer ceramic transmission line device using vertically stacked spiral conductors, in accordance with the present invention.

FIG. 3 shows yet another multilayer substrate arrangement 300, including top substrate 302, that employs spiral structures as the conductive layers. In particular, spiral conductors 310–312 and 314 are disposed on dielectric substrates 306–308 and 304, respectively, to effect a multilayer transmission line device in accordance with the present invention. Like the full-ring annulus structures described with reference to FIG. 2, the spiral structures advantageously provide increased physical—and electrical—length for those applications with such requirements. Generally, such applications typically include those circuits operating in the 100 MHz–3 GHz frequency range, which frequencies require longer conductive lengths than do high frequency applications. Accordingly, the present invention allows for the manufacture of a low-volume transmission line device that can be used at frequencies substantially lower than those frequencies attainable using prior art techniques.

Figure 4:
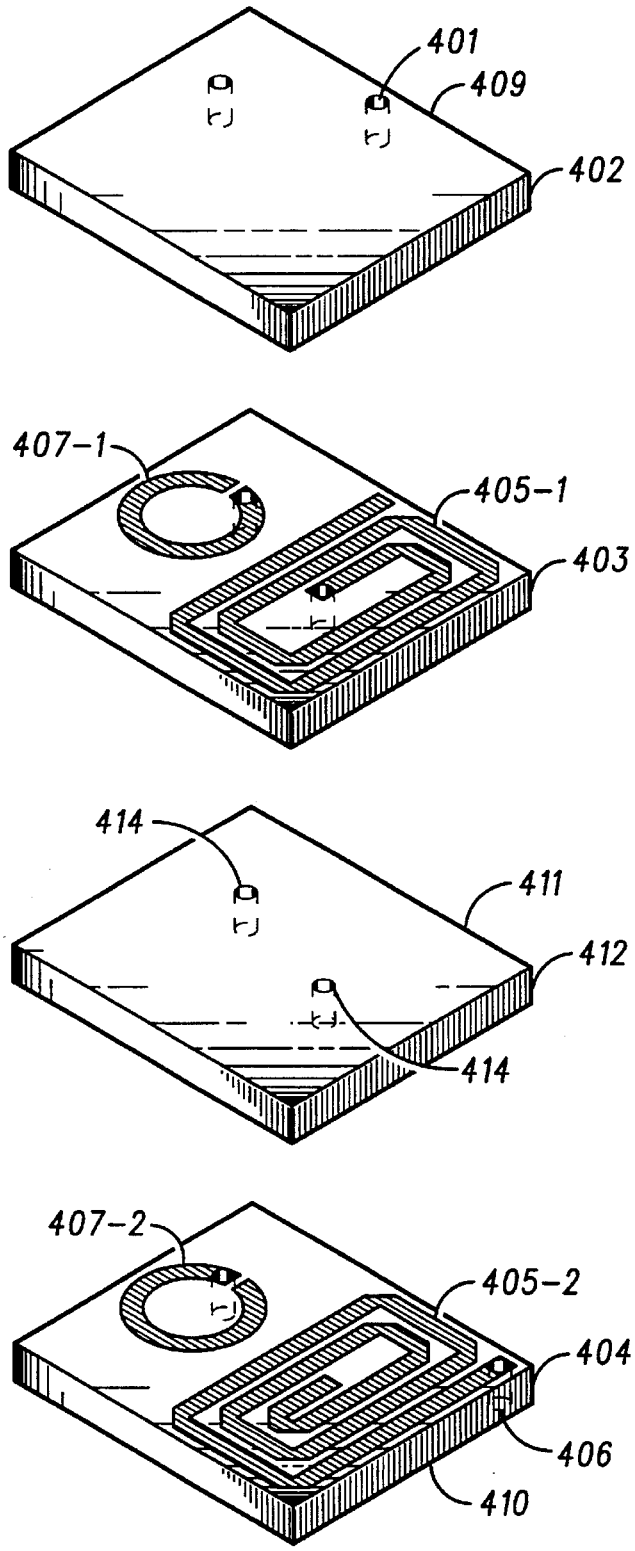
FIG. 4 shows a multilayer ceramic transmission line device that employs an embedded ground plane, in accordance with the present invention.

FIG. 4 shows a transmission line device 400 that employs multiple coil structures that might be designed to operate substantially independently from each other. In particular, top substrate 402, intermediate substrate 403, and bottom substrate 404 act in concert to embody a pair of transmission line devices 405 (i.e., 401-1, 405-2), 407 (407-1, 407-2). Further, a metallized layer 409 disposed on a first major surface of top substrate 402 provides a first ground plane, while an additional ground plane 410 might be disposed on a major surface of dielectric substrate 404. In a preferred embodiment of the invention, an embedded ground plane 411 is disposed between coil sections 405-1 and 405-2 (note that coil structure 405 includes input means 401 and output means). Likewise, the embedded ground plane disposed on substrate 412 lies substantially between the coil portions 407-1 and 407-2.

As shown, coil structure 405 can be implemented using a spiral conductive pattern as shown in FIG. 3, while coil structure 407 can be embodied using a ring-like pattern as shown in FIG. 2. It should be further noted that conductive vias 414 are disposed in dielectric substrate 412 to permit the signal to pass from the top portions of the coil structures 405-1,407-1 to the bottom portion of the coil structures 405-2, 407-2. Constructed in this manner, the transmission line arrangement 400 offers an improved ground plane arrangement that prevents inter-stage shielding of the ground plane. Accordingly, the increased capacitive reactance of each of the coil stages plays an effective role in maintaining the characteristic impedance of the transmission line device associated therewith.

Figure 5:
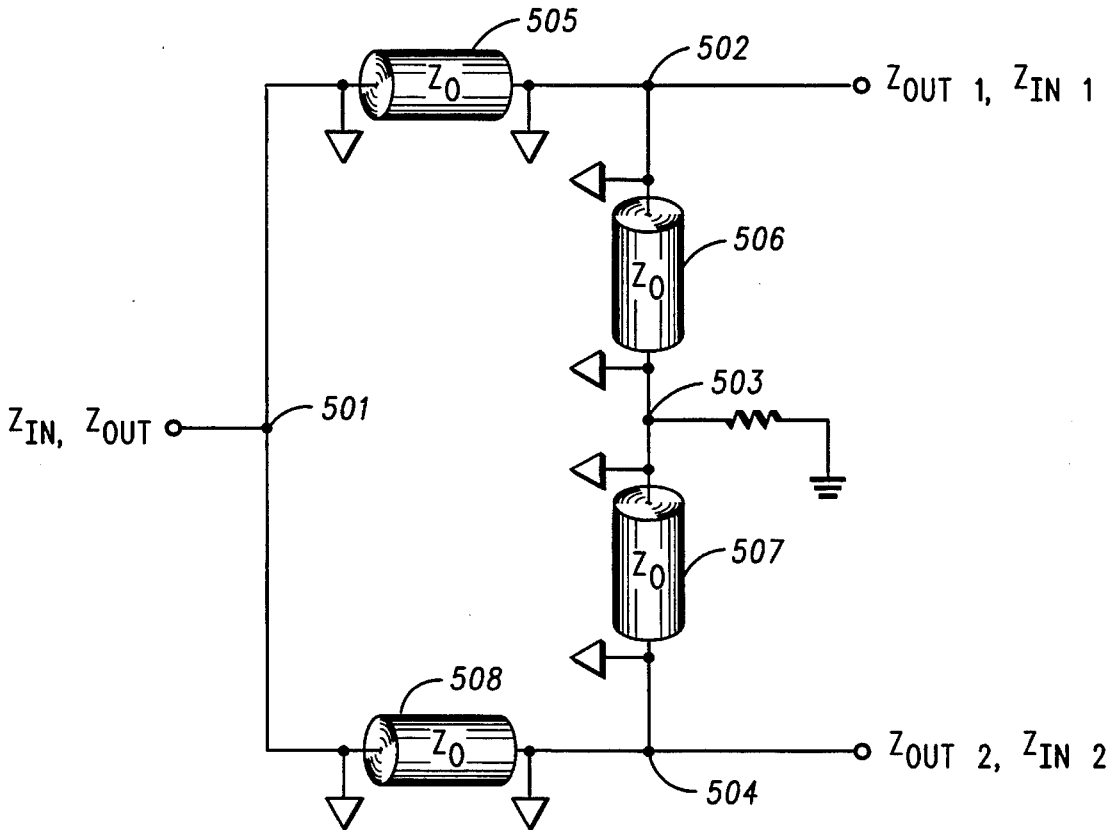
FIG. 5 shows a circuit that employs a plurality of transmission line devices, which circuit might advantageously employ embedded ground planes, in accordance with the present invention.

FIG. 5 shows a circuit arrangement 500 that graphically represents a so-called phase-inverting impedance transformer, sometimes referred to as a "rat-race" coupler. Circuit arrangement 500 is but one example of a circuit that relies on multiple transmission line devices to get a desired electrical result. In particular, circuit arrangement 500 relies on four transmission line devices to split an input signal—presented at node 501—into isolated nodes 502, 504; such an arrangement is commonly referred to as a power splitter. It should be noted that nodes 502, 504 might also be configured to receive input signals, while circuit arrangement 500 provides for the combination of those input signals at node 501; such an arrangement is commonly referred to as a power combiner. Electrical node 503 represents a point in the circuit 500 from which a resistor can be tied to ground, thereby providing isolation between nodes 502, 504. Transmission line devices 505–508 are arranged in the manner shown to effect the phase inverting impedance transformation according to the equation:

$$Z_0 = (2 \cdot Z_{in} \cdot Z_{out})^{1/2} \quad (1)$$

Further, it should be noted that while transmission line devices 505–507 represent one-quarter wave transmission lines, transmission line device 508 is required to be a three-quarter wave device. That is, a total of 1.5 wavelengths are required to bring about the desired electrical result. Of course, at frequencies below 1 GHz, the rat-race coupler design is not feasible without the aforementioned multilayer ceramic technique. Accordingly, the present invention provides a unique solution for those applications requiring multiple transmission line devices, or those having relatively long electrical length requirements. Further, the undesired electric field obstruction inherent in the plurality of required coil stages is substantially eliminated using the embedded ground planes, as next described.

Figure 6:
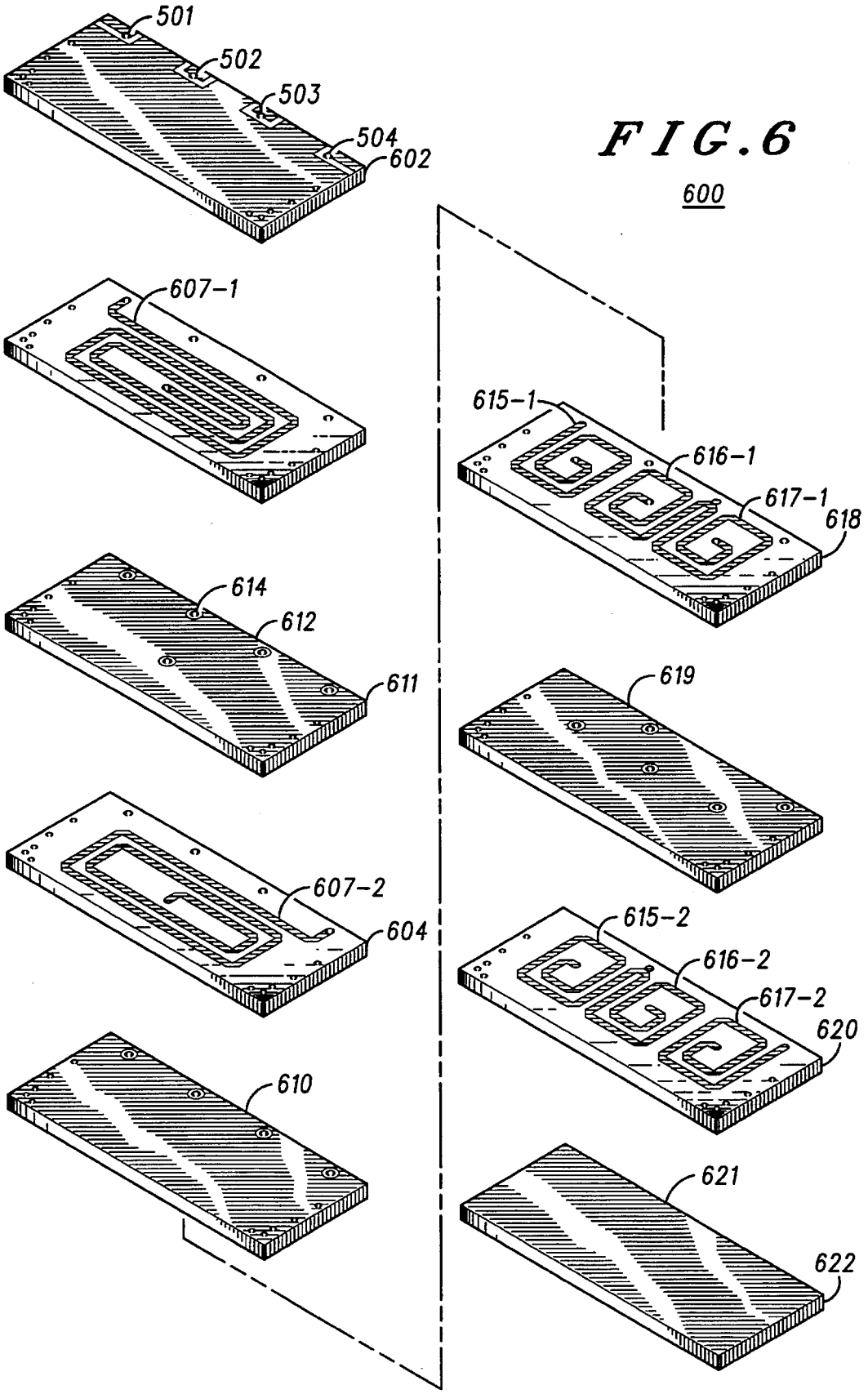
FIG. 6 shows the circuit of FIG. 5 as it might be constructed in accordance with the present invention.

FIG. 6 shows a preferred embodiment for the phase inverting, impedance transforming circuit 500 shown in FIG. 5. Electrical nodes 501–504 are shown on a top substrate 602 as input/output pads electrically coupled to conductive vias. These conductive vias, as well as others that are appropriately placed throughout the nine substrate layers, are used to pass signals from one layer to another, in a well known manner. Generally, the circuit arrangement 500 comprises one, three-quarter wave transmission line device 607 and three, one-quarter wave transmission line devices 615–617 (it is noted that devices 607 and 615–617 each comprise two coil structures identified, for device X, as X-1 and X-2). The-longer coil structure 607 is embodied using sections 607-1 disposed on substrate 603 and coil section 607-2 disposed on dielectric substrate 604. Further, a metallized area 611 is selectively deposited on substrate 612 and serves as an embedded ground plane for coil structure 607, in accordance with the present invention. Conductive via 614 is used to pass the electrical signal from the first coil section 607-1 to the second coil section 607-2. In this manner, a relatively long conductor can be confined to a small area by taking advantage of the available space in the z-direction (i.e., height) available, while not suffering from the inter-coil problems seen in the prior art.

The three, one-quarter wave transmission line devices 615–617 are similarly disposed on layers 6, 7, and 8. In particular, substrate 618 supports first coil sections 615-1, 616-1, 617-1, while substrate 620 supports secondary coil sections 615-2, 616-2 and 617-2. Further, an embedded ground plane 619 is deposited between the first and second coil stages for each of the one-quarter wave transmission line devices, in accordance with the present invention. In a preferred embodiment, an optional ground plane 621 is deposited on a dielectric substrate 622 (i.e., bottom substrate), to provide an improved capacitance rating for each of the transmission line devices disposed between the top substrate 602 and the bottom substrate 622. Further, an isolating ground plane 610 is preferably added, as shown, to electrically isolate the first and second transmission lines for more stable performance.

In the foregoing manner, a complex electrical circuit that requires many transmission line devices can be constructed in a relatively small area, resulting in a package having a substantially reduced volume. Thus, the present invention ensures a low cost, low volume solution for those electrical circuits employing a plurality of transmission line devices, even those required to operate at relatively low frequencies.

What is claimed is:

1. An electrical circuit that includes a plurality of vertically stacked dielectric substrates, comprising:

first input means for providing an input signal;

first output means for providing an output signal;

a first transmission line device electrically positioned between the first input means and the first output means, wherein the first transmission line device comprises:

a first ground plane disposed on a first of the plurality of vertically stacked dielectric substrates;

a first non-grounded conductive layer, having a first end connected to the first input means and a second end, that at least partially encloses a first area on a second of the plurality of vertically stacked dielectric substrates;

a second conductive layer, operably coupled at a first end to the second end of the first non-grounded conductive layer, that at least partially encloses a second area corresponding to the first area on a first major surface of a third of the plurality of vertically stacked dielectric substrates; and an embedded ground plane disposed on a fourth of the plurality of vertically stacked dielectric substrates that is positioned substantially between the second dielectric substrate and the third dielectric substrate; and a second transmission line device, comprising:

a third conductive layer, having a first end connected to the first input means and a second end, that at least partially encloses a third area on a fifth of the plurality of vertically stacked dielectric substrates;

a fourth conductive layer, operably coupled at a first end to the second end of the third non-grounded conductive layer, that at least partially encloses a fourth area corresponding to the third area on a first major surface of a sixth of the plurality of vertically stacked dielectric substrates; and a second embedded around plane disposed on a seventh of the plurality of vertically stacked dielectric substrates, that is positioned substantially between the fifth dielectric substrate and the sixth dielectric substrate.

2. The electrical circuit of claim 1, further comprising:

second input means, operably coupled to the second transmission line device, for providing an input to the electrical circuit.

3. The electrical circuit of claim 1, further comprising an isolating ground plane disposed on an eighth of the plurality of vertically stacked dielectric substrates and positioned substantially between the first transmission line device and the second transmission line device.

4. The electrical circuit of claim 3, further comprising a third ground plane disposed on a ninth of the plurality of vertically stacked dielectric substrates and positioned on an opposite side of the second transmission line device as the isolating ground plane.

5. The electrical circuit of claim 1, further comprising:

second output means, operably coupled to the second transmission line device, for providing an output for the electrical circuit.

6. The electrical circuit of claim 5, wherein the first transmission line device comprises a three quarter wavelength transmission line device.

7. The electrical circuit of claim 6, wherein the second transmission line device comprises at least a first one quarter wavelength transmission line device.

8. An electrical circuit that includes a plurality of vertically stacked dielectric substrates, comprising:

first input terminal for providing an input signal;

first output terminal for providing an output signal; and a first transmission line circuit electrically positioned between the first input terminal and the first output terminal, wherein the first transmission line circuit comprises:

a first ground plane disposed on a first of the plurality of vertically stacked dielectric substrates;

a first plurality of non-grounded conductive layers, at least one of the first plurality of non-grounded conductive layers having a first end connected to the first input terminal and a second end, and that each at least partially enclose an associated area on a second of the plurality of vertically stacked dielectric substrates;

a second plurality of conductive layers, wherein at least one of the second plurality of conductive layers is operably coupled at a first end to the second end of a corresponding one of the first plurality of non-grounded conductive layers, and that at least partially enclose areas corresponding to the associated areas on a first major surface of a third of the plurality of vertically stacked dielectric substrates;

a first embedded ground plane disposed on a fourth of the plurality of vertically stacked dielectric substrates that is positioned substantially between the second dielectric substrate and the third dielectric substrate; and an isolating ground plane disposed on a second major surface of the third dielectric substrate; and a second transmission line circuit electrically positioned between the first input terminal and the first output terminal, wherein the second transmission line circuit comprises;

a second ground plane disposed on a fourth of the plurality of vertically stacked dielectric substrates:

a third plurality of conductive layers that each at least partially enclose an associated area on a fifth of the plurality of vertically stacked dielectric substrates:

a fourth plurality of conductive layers that at least partially enclose areas corresponding to the associated areas on a first major surface of a sixth of the plurality of vertically stacked dielectric substrates; and a second embedded ground plane disposed on a seventh of the plurality of vertically stacked dielectric substrates that is positioned substantially between the second dielectric substrate and the third dielectric substrate.

9. The electrical circuit of claim 8, further comprising:

a second input terminal, operably coupled to the second transmission line circuit, for providing an input for the electrical circuit.

10. The electrical circuit of claim 9, wherein the first transmission line circuit comprises a three quarter wavelength transmission line circuit and the second transmission line circuit comprises at least a first one quarter wavelength transmission line circuit.

* * * * *